US005845694A

United States Patent [19]

Cohen

[11] Patent Number: 5,845,694

[45] **Date of Patent: *Dec. 8, 1998**

[54] HORIZONTAL VENETIAN BLIND

[76] Inventor: Leone A. Cohen, 21660 Birch St. Pkwy., Boca Raton, Fla. 33428

[ * ] Notice: The term of this patent shall not extend beyond the expiration date of Pat. No. 5,632,316.

[21] Appl. No.: 862,584

[22] Filed: May 23, 1997

Related U.S. Application Data

[63] Continuation-in-part of Ser. No. 511,997, Aug. 7, 1995, Pat. No. 5,632,316.

[51] Int. Cl.[6] ..... E06B 9/30

[52] U.S. Cl. ..... 160/168.1 R; 160/39; 160/178.1 R; 160/236

[58] Field of Search ..... 160/168.1 R, 166.1 R, 160/173 R, 178.1 R, 176.1 R, 177 R, 236, 39

[56] References Cited

U.S. PATENT DOCUMENTS

| | | |
|---|---|---|
| 4,699,196 | 10/1987 | Elliott . |
| 4,817,698 | 4/1989 | Rossini et al. . |
| 4,886,102 | 12/1989 | Debs . |
| 5,054,534 | 10/1991 | Hong . |
| 5,060,709 | 10/1991 | Simon . |
| 5,117,891 | 6/1992 | Simon . |
| 5,127,459 | 7/1992 | Markowitz . |
| 5,203,395 | 4/1993 | Koller et al. . |
| 5,254,034 | 10/1993 | Roth . |
| 5,271,447 | 12/1993 | Aronovich . |
| 5,303,760 | 4/1994 | Perez . |
| 5,341,864 | 8/1994 | Rupel et al. . |
| 5,386,867 | 2/1995 | Chen . |

FOREIGN PATENT DOCUMENTS

| | | |
|---|---|---|
| 2025441 | 3/1992 | Canada . |
| 0491096 | 6/1992 | European Pat. Off. . |
| 0491097 | 6/1992 | European Pat. Off. . |
| 6409755 | 2/1966 | Netherlands . |
| 0433678 | 9/1967 | Switzerland . |
| 1000626 | 8/1965 | United Kingdom . |

*Primary Examiner*—Blair M. Johnson
*Attorney, Agent, or Firm*—Needle & Rosenberg

[57] ABSTRACT

A venetian blind with individually adjustable slats. Each slat has multi-layered decorative slat extensions mounted in a slat extension holder. The individual slat extensions are mounted directly above one another in the unextended position. Each slat can be individually adjusted in length by sliding the slat extensions in opposite directions. The slats in the blinds can be now be extended to allow the blind to be used on windows of varying width. Each slat can be individually adjusted to allow the blind to be used interchangeably or on odd shaped windows, such as arched windows. The cords used to control slat position and the cords used to raise and lower the slats are mounted on the edge of the slats which do not have holes. In addition, a slat holder is described one of its slat extension grips set back from the edge of the slat holder. Slat inserts, constructed of PVC or fabric, for example, can be placed in the slat holder between the slat grips while one or more holes are punched into the space between the edge and the slat grip for accommodating the lift cords and/or tilt cords. A custom venetian blind can be constructed using these slat holders with a single slat extension placed therein.

23 Claims, 11 Drawing Sheets

HORIZONTAL VENETIAN BLIND

REFERENCE TO RELATED APPLICATIONS

This application is a continuation-in-part of U.S. application Ser. No. 08/511,997, filed Aug. 7, 1995, U.S. Pat. No. 5,632,316.

FIELD OF THE INVENTION

The present invention relates generally to horizontal blinds, commonly known as venetian blinds and more particularly relates to venetian blinds having individually adjustable slats and to venetian blinds with slats having removable inserts.

BACKGROUND OF THE INVENTION

Venetian blinds are a convenient way to adjust the relative amount of light entering a room. However, due to their complicated structure, venetian blinds tend to be expensive. This is particularly true in regard to blinds which use decorative slats. It would be advantageous for the owner of venetian blinds to be able to conveniently change the slats on venetian blinds to accommodate changes in interior design, for example, to match changes in wallpaper, paint, etc. In the area of vertical blinds, prior art attempts to replace vertical blind slats have been successful. Individual vertical slats are easily replaced because they generally are secured only at the top and do not have to accommodate cords for tilting or raising as do horizontal blinds. As a result, prior art systems are available which provide for easy replacement of vertical blinds. For example, prior art systems are known which use vertical blinds in which each blind contains a portion of a larger image. When the individual blind slats are assembled, the resulting blind displays a single image much like a mural. Because vertical blinds arc easily replaceable, the image can be easily changed when desired. Other known vertical blind systems provide the ability to remove a vertical blind which is structured as a clear case with a replaceable insert for decorative purposes. These systems rely on the easy removal of vertical blinds which is based on the absence of cords.

While cosmetic replacement of vertical blinds is relatively easy, the replacement of horizontal slats on currently available venetian blinds is relatively difficult and cannot be done by the user of the blinds without disassembly of the cords which extend from the head rail assembly through each of the slats. The prior art has failed to provide an easily replaceable venetian blind slat which permits a user to replace slats without tampering with the tilt or lift cords.

Another drawback to prior art venetian blind systems is the extraneous light which penetrates Venetian blinds through the cord holes in the slats. One prior art method of addressing this problem has been to position the cord holes such that when the venetian blinds arc closed, the cord holes are covered by the slat which is adjacent to the slat with the cord hole. However, this method only works when the venetian blind is completely closed. If the blind is in any other position than closed, light will penetrate the cord holes. This method, therefore, only provides a partial solution to the problem of extraneous light passing through cord holes.

Another prior art attempt to address light penetration through cord holes has been in the area of pleated fabric shades. One solution in this area has been to manufacture pleated shades with dual fabric panels, each panel having a series of cord holes which are offset from the cord holes in the adjacent panel. The disadvantage of this approach is the added cost of having dual panels. This method, however, is not feasible for venetian blind slats because the cost of the resulting blinds would be prohibitively high.

While the prior art has recognized the problems associated with light penetration through cord holes, the solutions heretofore devised have been ineffective for venetian blinds because they do not work over the full range of slat tilting or are prohibitively expensive.

Another problem associated with prior art venetian blinds is the expense associated with custom building them to fit a particular window frame. The prior art has attempted to provide adjustable venetian blinds when used with rectangular window frames. However, due to the use of cord holes and the tilt and lift cords which are inserted through them, prior art designs are mostly suitable only for rectangular windows. These solutions are incapable of being adjusted to fit odd shaped windows because the tilt and lift cords require all of the slats to be moved in unison. As a result, they cannot be used with arched or angled windows and slat replacement for aesthetic reasons is prevented by the presence of the cord holes and tilt and lift cords.

Thus, the prior art, has failed to provide an adjustable venetian blind which allows a user to easily replace slats without removal or alteration of the tilt or lift cords. In addition, the prior art has failed to provide an adjustable venetian blind in which each slat can be individually adjusted for use with rectangular or arch shaped windows, e.g., arched windows. Further, the prior art fails to disclose a venetian blind which reduces extraneous light penetration by eliminating cord holes or a Venetian blind slat permitting removal of slat inserts placed therein.

SUMMARY OF THE INVENTION

The present invention solves the foregoing problems by providing venetian blinds with individually adjustable multi-layer slats that have no holes in their light blocking portions. Each multi-layer slat has at least two decorative slat extensions mounted in a slat holder. The individual slat extensions are mounted directly above one another in the unextended position which provides the minimum width venetian blind. Each slat can be individually adjusted in length by sliding the individual slat extensions in opposite directions. A slat holder supports the slats as they are extended to fit windows of varying width. The length of each slat can be individually adjusted to allow the venetian blind to be used interchangeably on rectangular windows or on odd shaped windows such as arched windows. The cords used to control slat position and the cords used to raise and lower the slats are mounted on the edges of the slats. The cords are edge mounted on the slats to allow the slats to be manufactured without cord holes. The head rail has an additional hole at each end to provide and offset for the rear lifting cord. In addition, the slat holder can be utilized in a custom manner with a single slat removable inserted into the slat holder. Further, a slat holder is disclosed having one of its slat insert grips set back from the edge. Within the space between the slat grip and the edge one or more holes or apertures are placed for the lifting cords. This slat holder has applications in custom venetian blinds where PVC or fabric slat inserts are cut to length and placed between the grips of the slat holder.

There is therefore provided in accordance with the present invention a venetian blind, comprising a head rail having a lift cord drive assembly and a tilt cord drive assembly, a plurality of lift cords attached to the lift cord drive assembly in the head rail, each lift cord comprising a front lift cord, a rear lift cord, and a plurality of tilt cords attached to the tilt cord drive assembly in the head rail, each tilt cord comprising a front tilt cord, a rear tilt cord, and a plurality of cord rungs connecting the front tilt cord and the rear tilt cord, a plurality of elongate slats, at least one of which is an independently adjustable slat, each slat comprising an elongate slat holder having a front edge and a rear edge along opposing longitudinal edges of the slat holder, the slat holder further having a an elongate front grip substantially flush with the front edge and an elongate rear grip set back from the rear edge, a plurality of elongate slat extensions, the plurality of slat extensions inserted in the slat holder one overlapping another and slideably held by the front and rear edge grips, each slat extension independently movable with respect to the other slat extensions such that the width of the can be varied independently of other slats in the venetian blind, and wherein the front tilt cord and the front-tilt cord extending outside of and adjacent to the front edge of the slat holder, the rear lift cord extending through a plurality of apertures in the slat holder functioning as cord guides and positioned between the rear grip and the rear edge, and wherein each slat rests on at least a pair of cord rungs and neither the front tilt cord, the rear tilt cord, the front lift cord or the rear lift cord pass through any of the plurality of slat extensions.

At least one of the slat holders includes an aperture for the rear tilt cord and an aperture for the rear lift cord offset from each other such that the operation of the rear tilt cord does not interfere with the operation of the rear lift cord.

The head rail further comprises a set of rear tilt cord apertures, a set of rear lift cord apertures, and wherein the set of rear lift cord apertures is offset from the set of tilt cord apertures and substantially aligned with the apertures in the slat holder such that when the lift cord exits the head rail, it is in substantial alignment with the apertures.

The venetian blind further comprises a width adjustable valance, the width adjustable valance having at least two adjustable valance segments capable of independent lateral extension and wherein the width of the valance can be varied independently of the width of the slats. The venetian blind further comprises a width adjustable bottom rail, the width adjustable bottom rail having at least two adjustable segments capable of independent lateral extensions and wherein the width of the bottom rail can be varied independently of the width of the slats. In addition, the slat extensions are removable without requiring disassembly of the tilt cords or the lift cords.

There is also provided in accordance with the present invention a venetian blind, comprising a head rail having a lift cord drive assembly and a tilt cord drive assembly, a plurality of lift cords attached to the lift cord drive assembly in the head rail, each lift cord comprising a front lift cord, a rear lift cord, and a plurality of tilt cords attached to the tilt cord drive assembly in the head rail, each tilt cord comprising a front tilt cord and a rear tilt cord, a plurality of elongate slats, at least one of which is an independently adjustable slat, each slat comprising an elongate slat holder having a front edge and a rear edge along opposing longitudinal edges of the slat holder, the slat holder further having a an elongate front grip substantially flush with the front edge and an elongate rear grip set back from the rear edge, a plurality of elongate slat extensions, the plurality of slat extensions inserted in the slat holder one overlapping another and slideably held by the front and rear edge grips, each slat extension independently movable with respect to the other slat extensions such that the width of the slat can be varied independently of other slats in the venetian blind, and wherein the front tilt cord and the front tilt cord extending outside of and adjacent to the front edge of the slat holder, the rear lift cord extending through a plurality of apertures in the slat holder functioning as cord guides and positioned between the rear grip and the rear edge, and wherein neither the front tilt cord, the rear tilt cord, the front lift cord or the rear lift cord pass through any of the plurality of slat extensions.

Further, there is provided in accordance with the present invention a venetian blind, comprising a head rail having a lift cord drive assembly and a tilt cord drive assembly, a plurality of lift cords attached to the lift cord drive assembly in the head rail, each lift cord comprising a front lift cord, a rear lift cord, and a plurality of tilt cords attached to the tilt cord drive assembly in the head rail, each tilt cord comprising a front tilt cord, and a rear tilt cord, a plurality of elongate slats, each slat comprising an elongate slat holder having a front edge and a rear edge along opposing longitudinal edges of the slat holder, the slat holder further having a an elongate front grip substantially flush with the front edge and an elongate rear grip set back from the rear edge, an elongate slat insert inserted in the slat holder and slideably held by the front and rear edge grips, each slat insert movable with respect to the slat holder, and wherein the front tilt cord and the front tilt cord extending outside of and adjacent to the front edge of the slat holder, the rear lift cord extending through a plurality of apertures in the slat holder functioning as cord guides and positioned between the rear grip and the rear edge, and wherein neither the front tilt cord, the rear tilt cord, the front lift cord or the rear lift cord pass through any of the slat inserts.

In addition, there is provided in accordance with the present invention a venetian blind, comprising a head rail having a lift cord drive assembly and a tilt cord drive assembly, a plurality of lift cords attached to the lift cord drive assembly in the head rail, each lift cord comprising a front lift cord, a rear lift cord, and a plurality of tilt cords attached to the tilt cord drive assembly in the head rail, each tilt cord comprising a front tilt cord, and a rear tilt cord, a plurality of elongate slats, each slat comprising an elongate slat holder having a front edge and a rear edge along opposing longitudinal edges of the slat holder, the slat holder further having a an elongate front grip substantially flush with the front edge and an elongate rear grip set back from the rear edge, wherein the front tilt cord and the front tilt cord extending outside of and adjacent to the front edge of the slat holder, the rear lift cord extending through a plurality of apertures in the slat holder functioning as cord guides and positioned between the rear grip and the rear edge, and wherein neither the front tilt cord, the rear tilt cord, the front lift cord or the rear lift cord pass through the area of the slat holder between the elongate front grip and the elongate rear grip.

BRIEF DESCRIPTION OF THE DRAWINGS

The invention is herein described, by way of example only, with reference to the accompanying drawings, wherein.

DETAILED DESCRIPTION OF THE INVENTION

Figure 1:
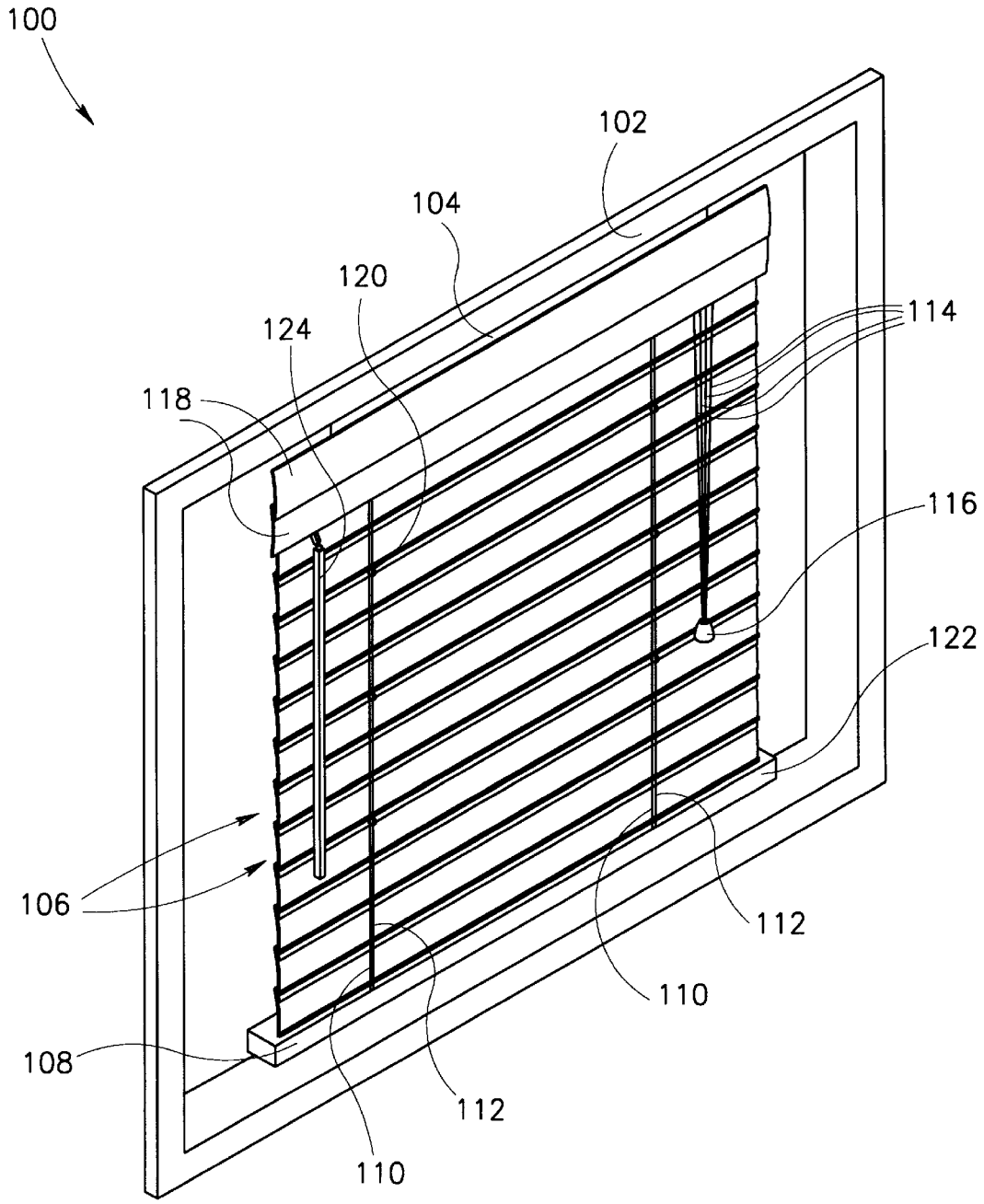
FIG. 1 illustrates a front view of a first embodiment of the adjustable venetian blinds in the unextended position constructed in accordance with the present invention.

The illustration of a front view of a first embodiment of the adjustable venetian blinds in the unextended position constructed in accordance with the present invention is shown in FIG. 1. The venetian blind, generally referenced 100, comprises a head rail 104 which is attached to front tilt cords 110 and front lift cords 112. Head rail 104 has a conventional tilt cord drive assembly (not shown) and a conventional lift cord drive assembly. Tilt cord drive assemblies and lift cord drive assemblies are well known in the art. Adjustable slats 106 are suspended from slat rungs 308 (described below with reference to FIG. 3) which are in turn attached to front tilt cords 110 and the rear tilt cords 206 (shown in FIG. 2).

In one embodiment of the present invention, each end of the head rail 104 has one set of front and rear tilt cords 110, 206, respectively, and one set of front and rear lift cords 112, 204, respectively. Tilt control rod 124 is attached to head rail 104 and operates front and rear tilt cords 110, 206 respectively. The tilt control mechanism embodied in head rail 104 and tilt control rod 124 is a conventional tilt control mechanism, well known in the art. Front cord guides 120 are attached to the edge of adjustable slats 106. For ease of illustration, front cord guides 120 are shown enlarged. Preferably, they are only large enough to accommodate movement of the tilt and lift cords 110, 112, respectively, selected for a particular venetian blind 100. As shown in FIG. 1, front cord guides 120 are not required on every adjustable slat 106.

Bottom rail segments 108, 122 are attached to front and rear lift cords in the conventional manner. Bottom rail segments 108, 122 are designed to telescope such that they can be extended when adjustable venetian blind 100 is extended. Lifting cords 114 are shown attached to the cord clamp 116. Lifting cords 114 are also attached to head rail 104 in the conventional manner. Decorative valence panels 118 are shown attached to head rail 104. In FIG. 1, the venetian blind 100 is shown mounted in window frame 102 in the unextended position, i.e., adjustable slats 106 have not been extended. In the unextended position, venetian blind 100 exhibits its minimum width. The principle advantage of this embodiment is the ability to adjust adjustable slats 106 such that the width of the venetian blind 100 can be varied. As a result, the same size venetian blind 100 can be used on windows having a variety of sizes. By using a single size for windows having a variety of sizes the venetian blind 100 can be manufactured less expensively.

With reference to FIG. 1, another advantage of the invention is that the adjustable slats 106 do not have cord holes because tilt cords 110, 206 and lift cords 112, 204 are routed along the edge of the adjustable slats 106. As a result, light penetration caused by cord holes is eliminated.

Figure 2:
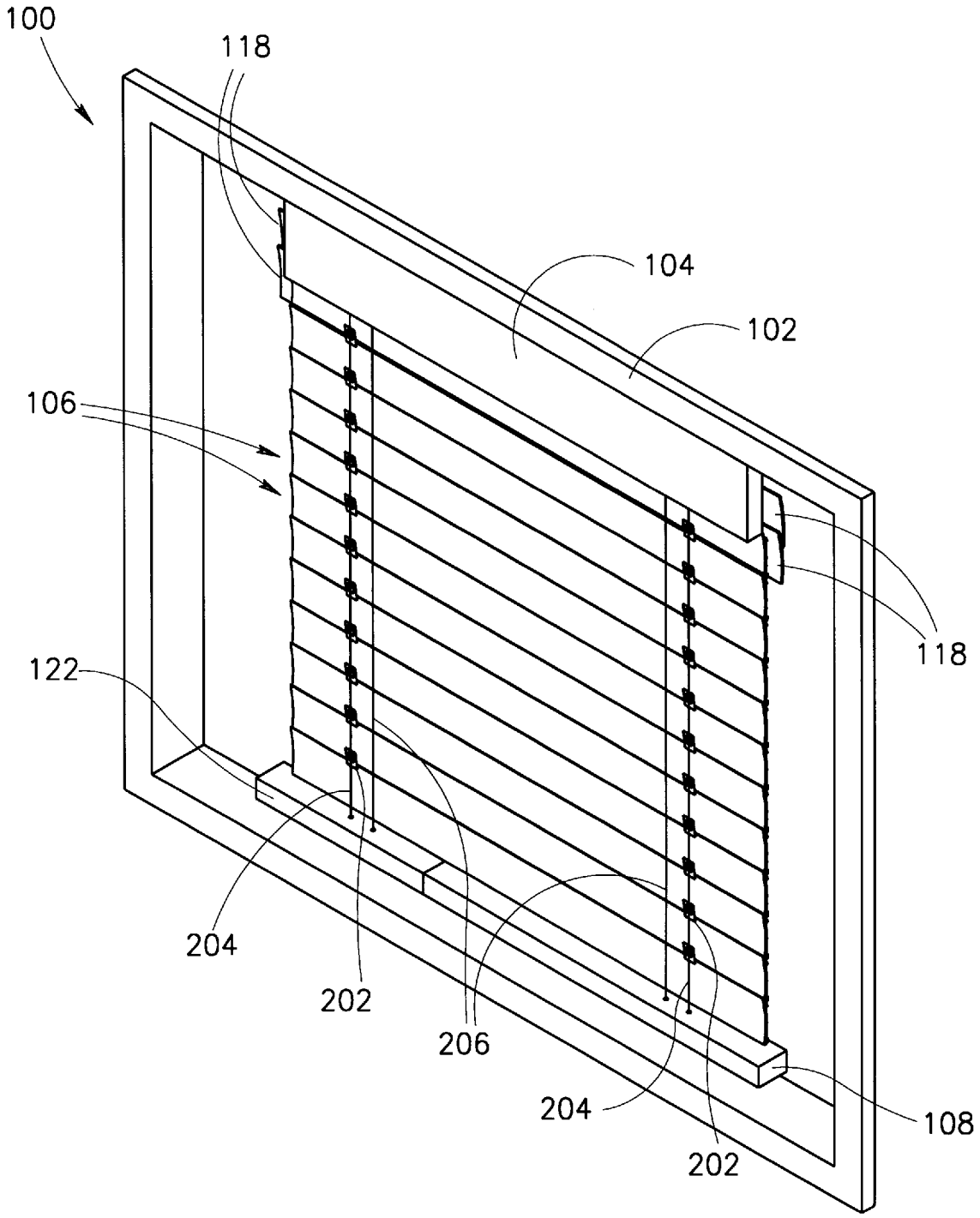
FIG. 2 illustrates a rear view of the embodiment of FIG. 1 in the unextended position.

A rear view of the embodiment of FIG. 1 in the unextended position is shown in FIG. 2. Rear lift cords 204 are preferably offset from rear tilt cords 206 by routing the rear lift cords 204 through the lift cord guides 202. The lift cord guides 202 are attached to the bottom of the adjustable slats 106. Preferably, the lift cord guides 202 are made from an inexpensive material such as plastic, polyethylene, etc., and are attached to the bottom of the slat holder 306 via adhesive. However, any suitable material may be used to fabricate the lift cord guides 202 and any suitable method of attachment can be utilized. By routing the rear lift cords 204 through the lift cord guides 202, the relative position of the adjustable slats 106 to one another is stabilized. The attachment of the lift cord guides 202 is explained more filly below in connection with FIG. 3.

Figure 3A:
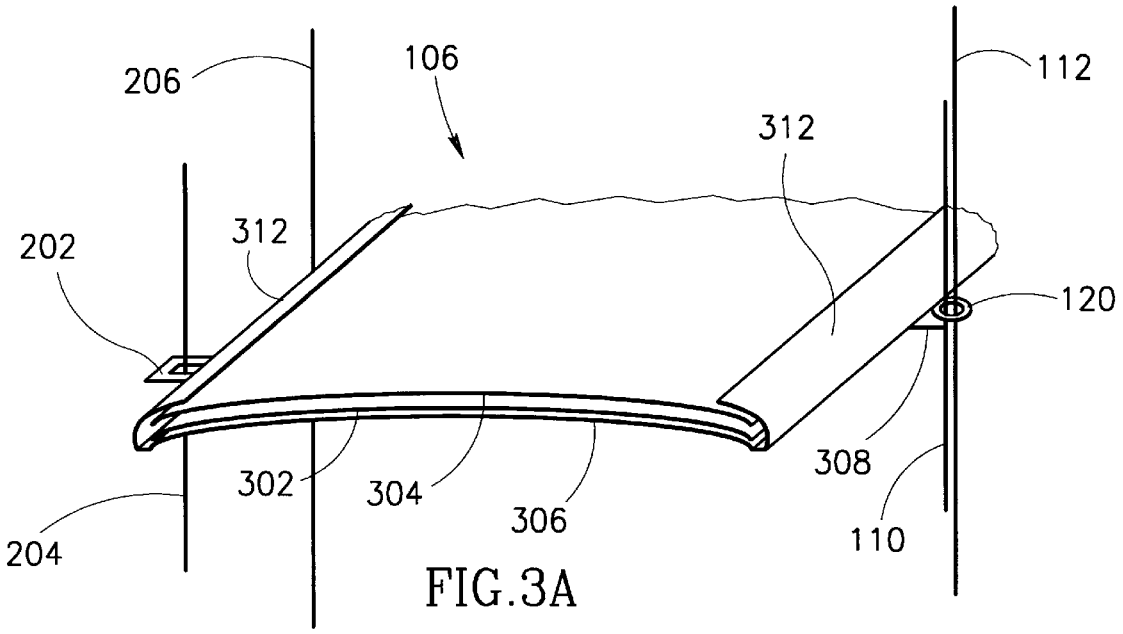
FIG. 3A is an end view of an adjustable slat of the venetian blind of the present invention illustrating the location of the slat extensions in the slat extension holder.

The adjustable slat 106 will now be described in more detail with reference to FIGS. 3A, 3B and 3C. An end view of an adjustable slat of the venetian blind of the present invention illustrating the location of the slat extensions in the slat extension holder is shown in FIG. 3A. Comprising a multi-layer structure, one slat extension 304 rests on top of the other slat extension 302 and both are held under pressure at their edges by slat extension grips 312 situated at the edge of the slat holder 306. Slat extensions 302, 304 do not have to be the same length. A cord guide 120 is attached to the front edge of slat holder 306 and functions to insert tilt cord 110. A lift cord guide.202 is attached to the rear edge of slat holder 306 and functions to encircle lift cord 204. Adjustable slat 106 rests on rung 308 which is attached at one end to the front tilt cord 110 and at the other end to the rear tilt cord 206. The rear lift cord 204 (FIG. 3B) is inserted through the rear lift cord guide 202.

When the entire length of the upper slat extension 304 rests directly on top of the entire length of the lower slat extension 302, the adjustable venetian blind 100 is at its minimum width. By sliding the lower slat extension 302 in one direction and the upper slat extension in the opposite direction, the total width of an individual slat 106 can be extended to fit a particular window size. Those skilled in the art will recognize that thinner slat extensions 302, 304 result in a less visible edge for the adjustable slat 106 when slats 302, 304 are extended. Note that any number of slat extensions can be inserted into the slat holder as long as the slat holder is designed to fit the slat extensions. To achieve length adjustability, however, a minimum of two slat extensions must be inserted into the slat holder.

Figure 3B:
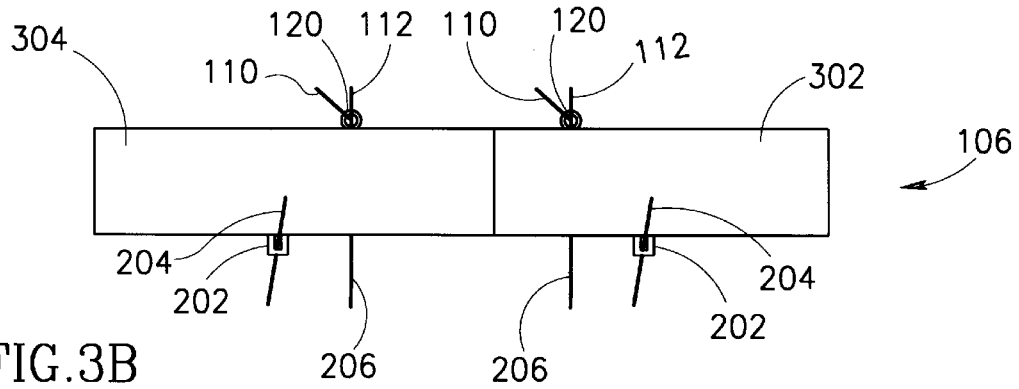
FIG. 3B is a top view of an adjustable slat of the venetian blind of the present invention illustrating the slat extensions in an extended position.
Figure 3C:
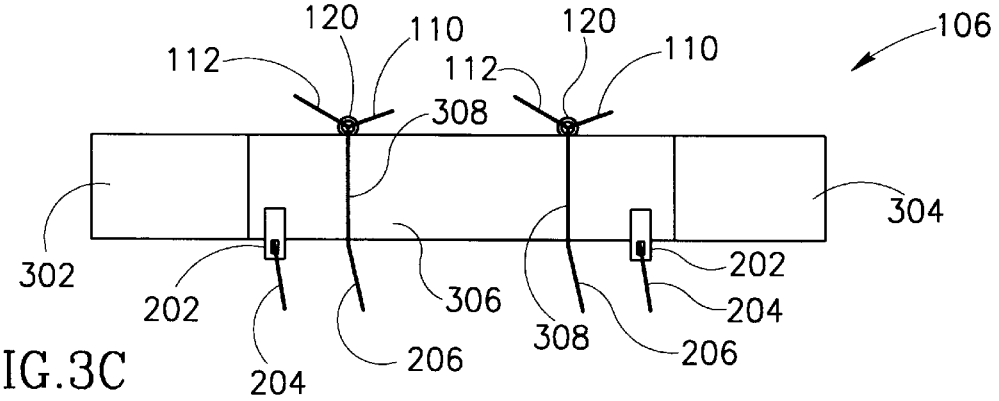
FIG. 3C is a bottom view of an adjustable slat of the venetian blind of the present invention illustrating the slat extensions in an extended position in addition to the slat extension support.

As shown in FIG. 3A–3C the front and rear tilt cords 110, 206, respectively and the front and rear lift cords 112, 204 respectively, are mounted on the edges of the adjustable slat 106. Therefore, each individual slat 106 can be independently adjusted since there is no need to and maintain cord holes in alignment between adjacent slats 106. The edges of the slat holder 306 are folded over to form slat extension grips which friction to hold slat extensions 302, 304 under sufficient pressure to avoid inadvertent slippage, but are loose enough to allow a user to manually slide slat extensions 302, 304 to the desired slat width. A cap view of an adjustable slat of the venetian blind of the present invention illustrating the slat extensions in an extended position is shown in FIG. 3B. The upper slat extension 304 is shown extended past the left end of the slat 106 and the lower slat extension 302 is shown extended past the right end of the slat 106. As a result, the total length of the slat 106 is increased.

A bottom view of an adjustable slat of the venetian blind of the present invention illustrating the slat extensions in an extended position in addition to the slat extension support is shown in FIG. 3C. The slat extensions 302, 304 are shown extended past the end of the slat holder 306 thus increasing the total width of the slat 106. Also shown is the lift cord guide 202. Preferably, the lift cord guide 202 is secured to the bottom of the slat holder 306. By routing the lift cord 204 through the lift cord guide 202, the slat 106 is stabilized and slippage is reduced. Further, by offsetting the lift cord guide 202 from the tilt cord 206, the lift cord guide 202 is prevented from interfering with the operation of tilt cords 110, 206.

Those skilled in the art will recognize that the slat extensions 302, 304 can be made from any suitable material such as plastic, fabric, etc. Likewise, although the slat holder 306 can be made from any suitable material, preferably a clear plastic is used to facilitate replacement of the slat extensions 302, 304 without regard to the color of the replacement extension slats 302, 304 inserted therein. Using a clear plastic material to construct the slat holder enables the user to control the translucence of the blind to light by choosing more translucent or more opaque slat extensions In addition, those skilled in the art will also recognize that the rungs 308 can be eliminated if the front and rear tilt cords 110, 206, respectively are attached directly to the slat holder 306. The embodiment shown in FIG. 1, however, uses conventional rungs in its construction.

Figure 4:
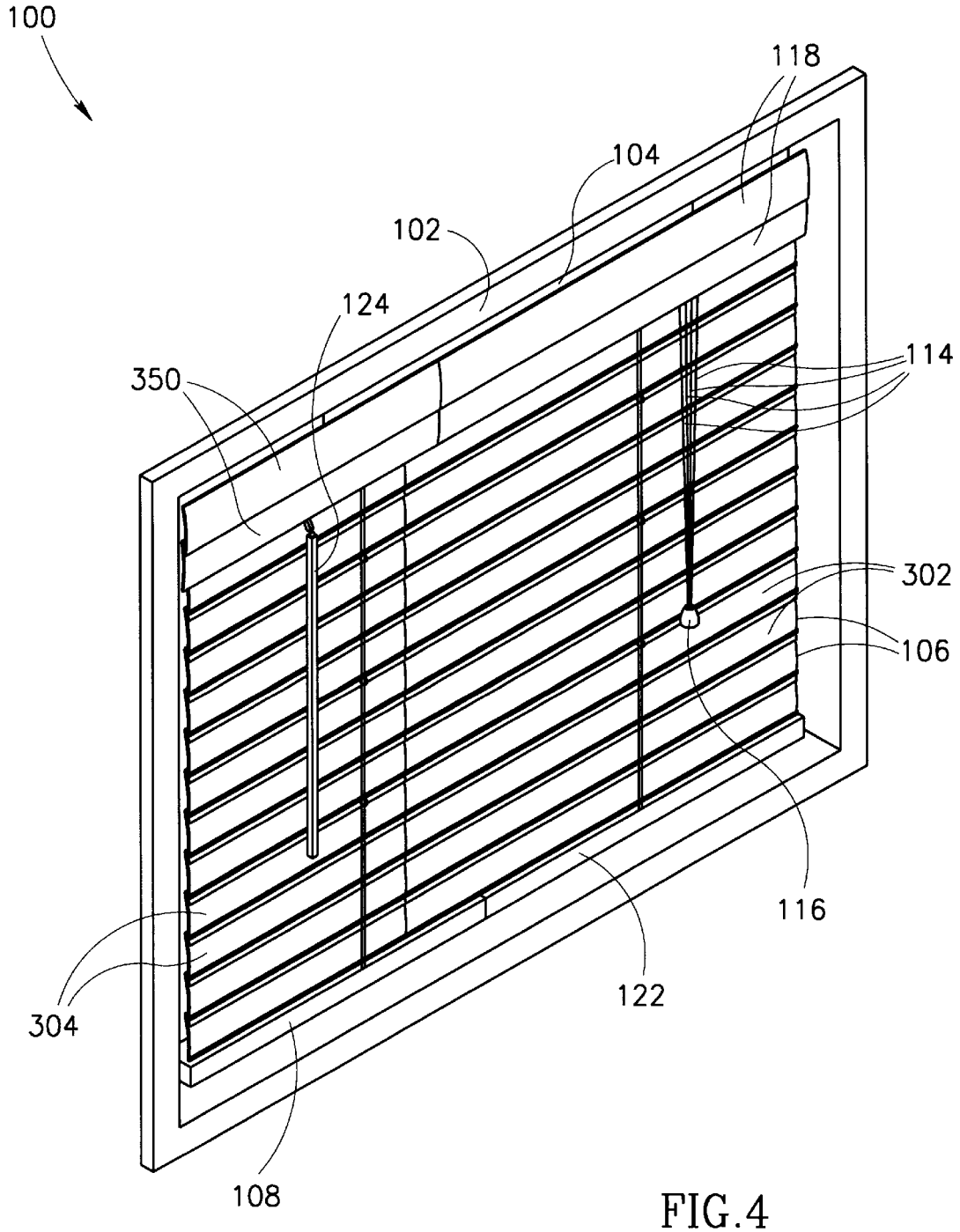
FIG. 4 is a front view of the embodiment of FIG. 1 installed in a typical rectangular window frame illustrating the adjustable venetian blinds in the extended position.

A front view of the embodiment of FIG. 1 installed in a typical rectangular window frame illustrating the adjustable venetian blinds in the extended position is shown in FIG. 4. As can be seen in the figure, the slat extensions 302, 304 are extended in opposite directions such that the adjustable slats 106 are extended in length to fill the window frame 102. Also shown in the figure is a valence extension 350. The valence 118 and the valence extension 350 are held by a valence grip (not shown) implemented in the same manner as slat holder 306. The valence 118 and the valence extension 350 can be identical and interchangeable. For purposes of discussion, they are considered to be adjustable valence segments. This allows the valence 118 to be adjusted in width in the same manner as the adjustable slats 106. An important advantage of the present invention is that it permits an inexpensive, adjustable venetian blind to be installed by a user. Thus, the user is not required to purchase a more expensive custom made venetian blind. Further, the slat extensions 302, 304 can be replaced either for maintenance or for aesthetic reasons without requiring disassembly of the venetian blind, i.e., disassembly of the tilt and lift cord mechanisms.

Figure 5:
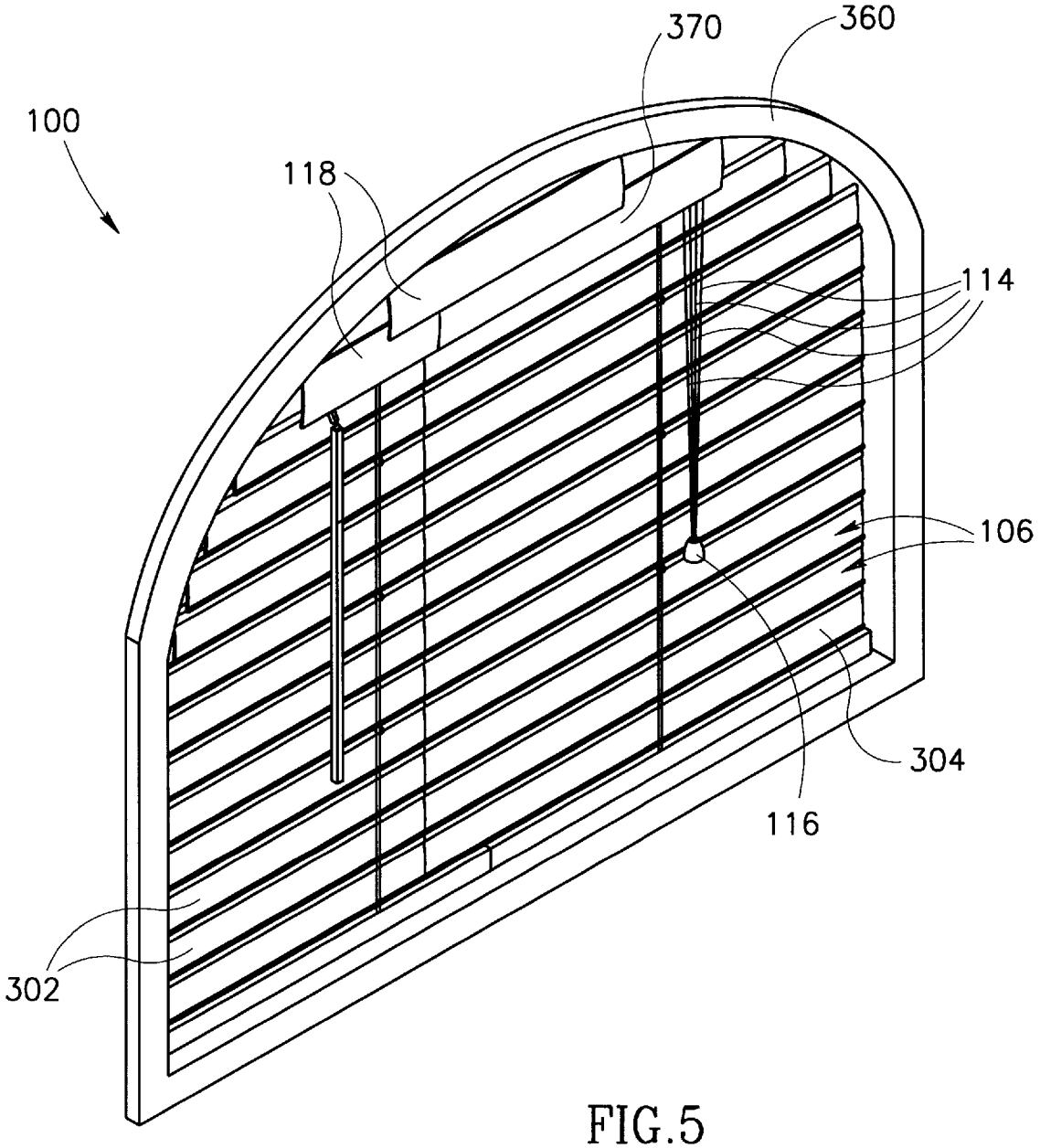
FIG. 5 is a front view of the embodiment of FIG. 1 installed in an irregularly shaped window frame illustrating the individually adjustable slat of the venetian blinds in the extended position.

A front view of the embodiment of FIG. 1 installed in an irregularly shaped window frame illustrating the individually adjustable slats of the venetian blinds in the extended position is shown in FIG. 5. FIG. 5 illustrates a unique advantage associated with the present invention. Mainly, the individually adjustable slats 106 of the present invention provide the ability of a user to use a standard off the shelf adjustable venetian blind for odd shaped windows. Prior to the present invention incorporating individually adjustable slats, venetian blinds for odd shaped windows had to be custom made at high cost. As shown in FIG. 5, the adjustable venetian blind 100 is mounted in an arched window. A major advantage of constructing a venetian blind using individually adjustable slats is that each slat may be adjusted to fit the contours of a particular window frame. Prior art venetian blinds are incapable of use in this manner since the location of tilt and lift cords running through cord holes in the slats prevents the slats from being adjusted individually.

Note that it is also possible to fix width slats, i.e., custom slats, with the independently adjustable slats of the present invention. This configuration could be used in arched windows (as shown in FIG. 5) where only the top slats would comprise adjustable slats able to be varied in width.

Figure 6:
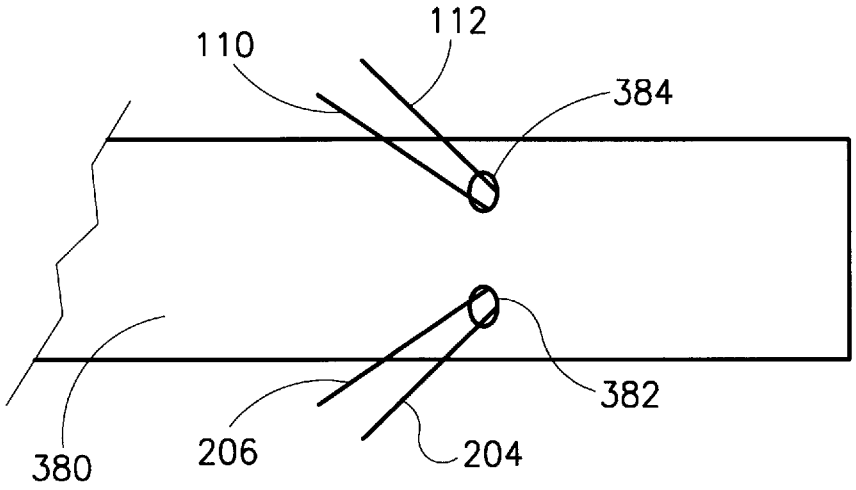
FIG.6 PRIOR ART
FIG. 6 illustrates a bottom view of a prior art head rail used with standard venetian blinds.

A bottom view of a prior art head rail used with standard venetian blinds is shown in FIG. 6. Prior art head rails 380 use a pair of apertures 382, 384 at each end of the head rail 380 to accommodate the tilt cords 110, 206 and lift cords 112, 204. The use of only two apertures prevents the rear lift cord 204 from being offset from the rear tilt cord 206.

Figure 7:
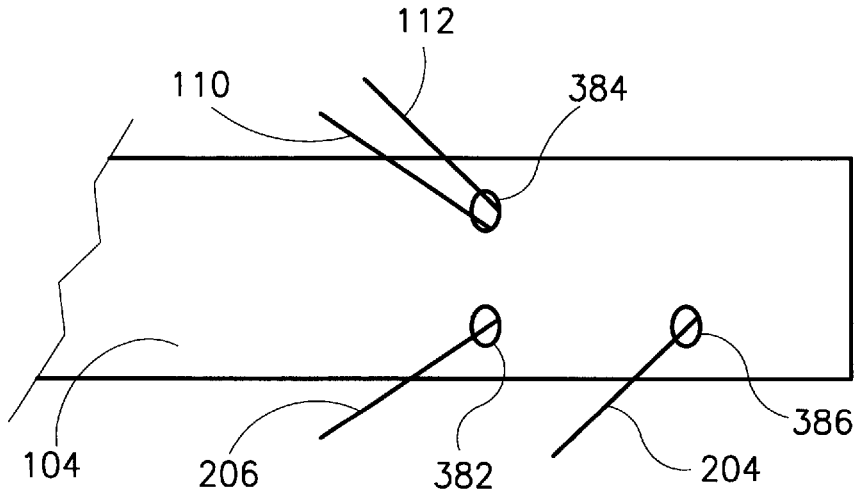
FIG. 7 illustrates a bottom view of the head rail used in the first embodiment showing the offset cord aperture.

A bottom view of the head rail used in the first embodiment showing the offset cord aperture is shown in FIG. 7. An additional aperture 386 is added to the head rail 104 and the lift cord is routed therethrough to provide an offset between the rear tilt cord 206 and the rear lift cord 204.

A result of the moving of the prior art cord holes from the slat and routing the tilt cords 110, 206 and lift cords 112, 204 along the outer edge of the slat is that the slat now accomplishes several functions not heretofore available.

First, the absence of cord holes eliminates the annoying problem of light entering a room through the cord holes regardless of the tilt position of the slats.

Second, and more importantly, since the movement of the individual slats 106 are no longer constrained by the cords which ran through the slats in prior art venetian blinds, the slats of the present invention now can be made in slideable multi-layer form wherein each slideable layer is width adjusted independently of the width adjustment of the other slats in the venetian blind. As a result of this feature, the adjustable venetian blinds of the present invention can be used off the shelf for a variety of window sizes, resulting in a substantial savings to the consumer since the consumer can avoid purchasing expensive custom made venetian blinds. In addition, the offset lift cord guide 202 and the offset lift cord aperture 386 provide additional stability to the slat structure.

Third, since each slat is independently adjustable, the venetian blind of the present invention can also be used for odd shaped or arched windows similar to that discussed above in connection with FIG. 5. This feature provides substantial savings to the consumer. Heretofore, a consumer with a window shaped like the window in FIG. 5 was required to have venetian blinds custom made since the possibility of finding the correct size in an off the shelf venetian blind was remote. The venetian blind of the present invention allows the consumer to purchase an inexpensive, off the shelf venetian blind that fits a broad range of odd shaped window sizes due to the use of independently adjustable slats.

Fourth, the removability of the slide extensions 302, 304 and the valence segments 118, 350 allow the user to periodically alter the appearance of odd shaped venetian blinds. This would have been prohibitively expensive with the custom made arch shaped venetian blinds of the prior art.

Figure 8:
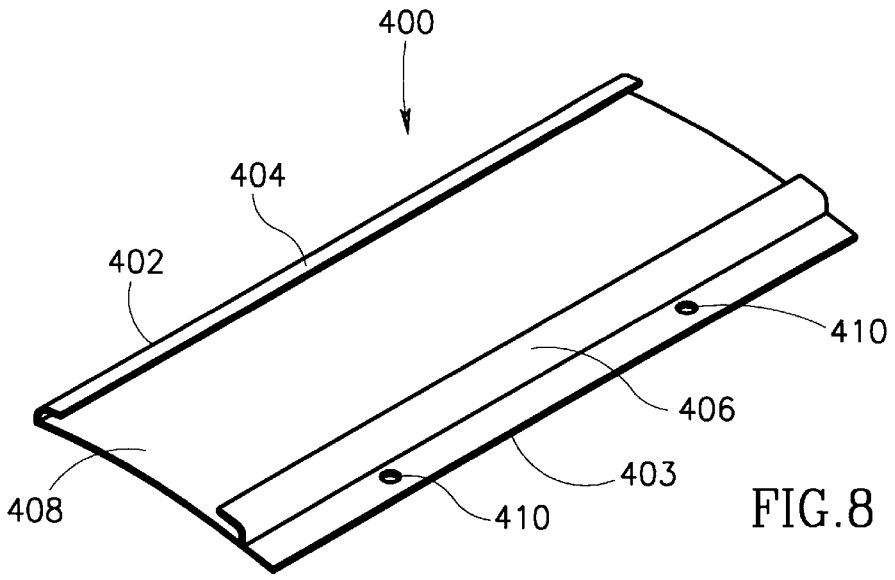
FIG. 8 is a prospective view illustrating a slat holder having one slat extension grip set back from the edge constructed in accordance with a second embodiment of the present invention.

A perspective view illustrating a slat holder having one slat extension grip set back from the edge constructed in accordance with a second embodiment of the present invention is shown in FIG. 8. In a second embodiment, the slat holder of FIG. 3A is replaced with the slat holder of FIG. 8. The slat holder, generally referenced 400, of FIG. 8 comprises a slightly arched elongated portion 408, front edge 402, rear edge 403, front slat grip 404, rear slat grip 406 and one or more optional holes 410.

Figure 9:
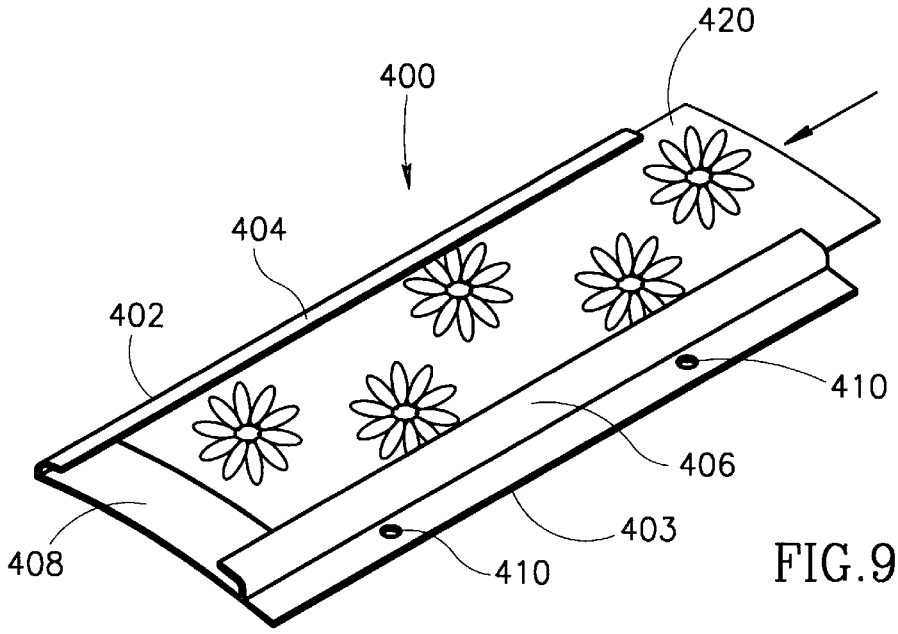
FIG. 9 is a prospective view illustrating the slat holder of FIG. 8 having a slat inserted within the slat extension grips.

A perspective view illustrating the slat holder of FIG. 8 having a slat inserted within the slat extension grips is shown in FIG. 9. In addition, a side sectional view illustrating the slat holder of FIG. 8 having a slat extension inserted within the extension grips is shown in FIG. 10.

Figure 10:
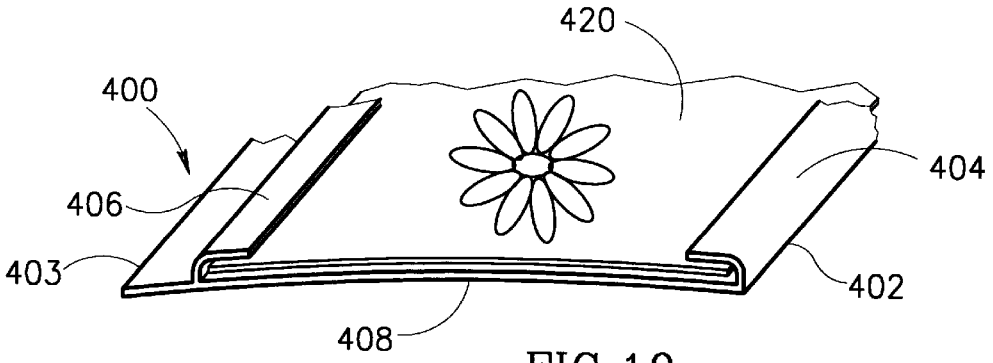
FIG. 10 is a side sectional view illustrating the slat holder of FIG. 8 inserted within the slat extension grips.

With reference to FIGS. 8, 9 and 10, the slat holder 400 is characterized by the rear slat grip set back a small distance from the rear edge 403. As in the slat holder of FIG. 3A, slat extensions can be removably inserted between the front and rear slat grips. The slat grips are constructed so as to firmly hold the slat extensions in place, but allow them to be slideably moved for adjustment to the width of a window frame. Similarly, the slat extensions, once installed, can be easily removed for cleaning or to facilitate changes in room decor without requiring the disassembly of the tilt or lift cord assemblies.

As in the slats of FIG. 3A, the slat holder provides for easier slat removal for cleaning, tighter closure to keep more light out, the ability to replace slat extensions to accommodate changes in decor and the ability to individually adjust the length of each slat to fit odd shaped windows.

Optionally, one or more holes 410 can be punched into the elongated portion 408 located between the rear slat grip 406 and the rear edge 403 in order to provide cord guides for the lift cord. By routing the lift cord near the rear edge, the slat extensions 420 can be removed without disassembly of the lift cord mechanism. The holes 410 can be formed using any suitable manufacturing technique such as punching, drilling or forming them initially during molding of the slat holder itself.

The slat holder 400 can also be used in custom venetian blind applications. Rather than insert two or more slat extensions for adjustably adapting to any odd shaped window frame, a single slat insert can be removably inserted into the slat holder. Although the benefits of adjustability of each slat are not achieved, the benefits of a removable slat insert are still enjoyed, i.e., easily removable for cleaning without requiring disassembly of the lift cord mechanism, no holes to permit light to leak through and the ability to change slat inserts to accommodate changes in decor.

When used in a custom venetian blind application, the slat holder commonly known as a channel panel, is custom fitted to the dimensions of the window frame it is to be installed in.

Figure 11:
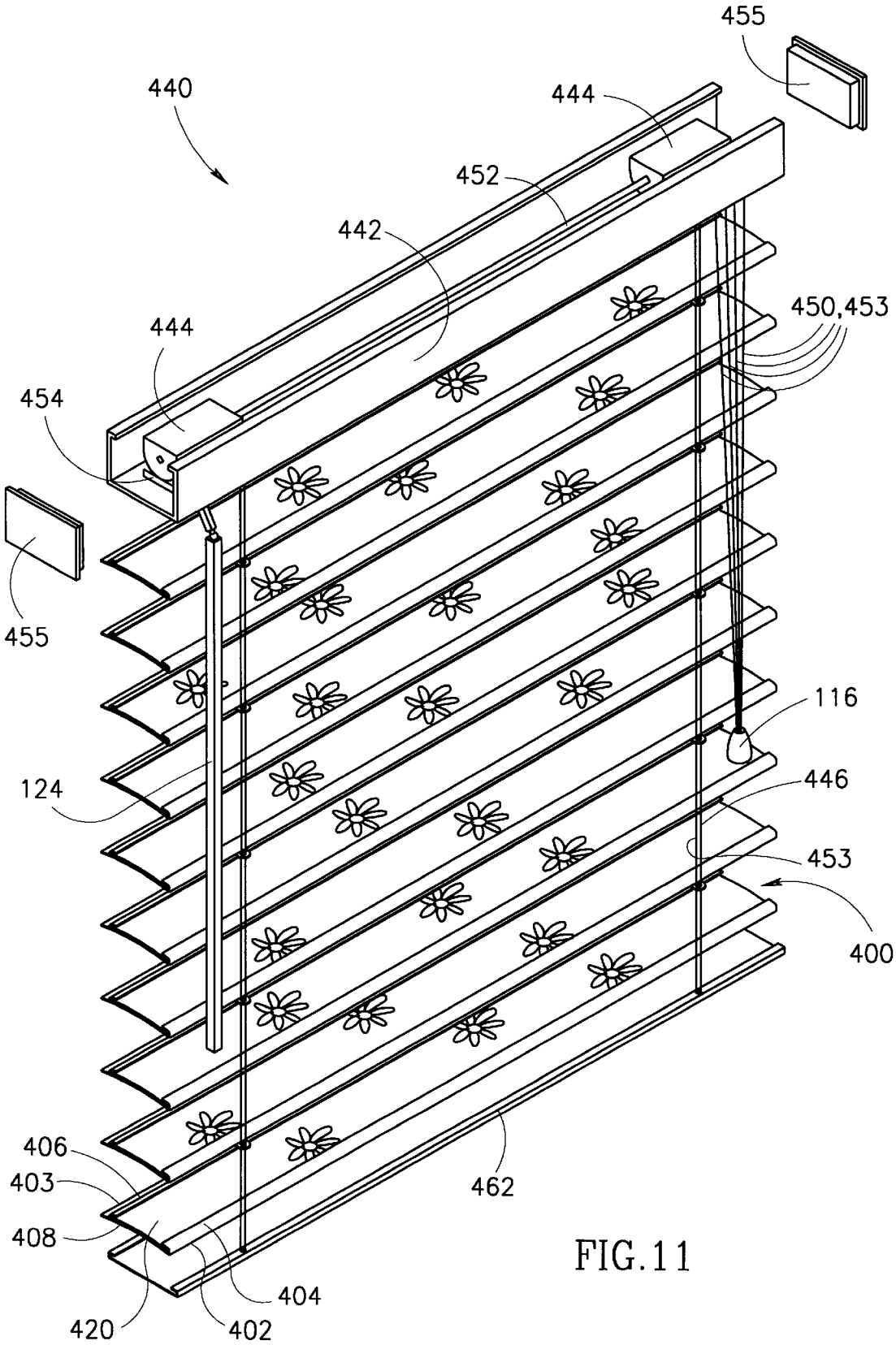
Fig. 11 is a front view illustrating a venetian blind constructed in accordance with the present invention using the slat holder of FIG. 8.
Figure 12:
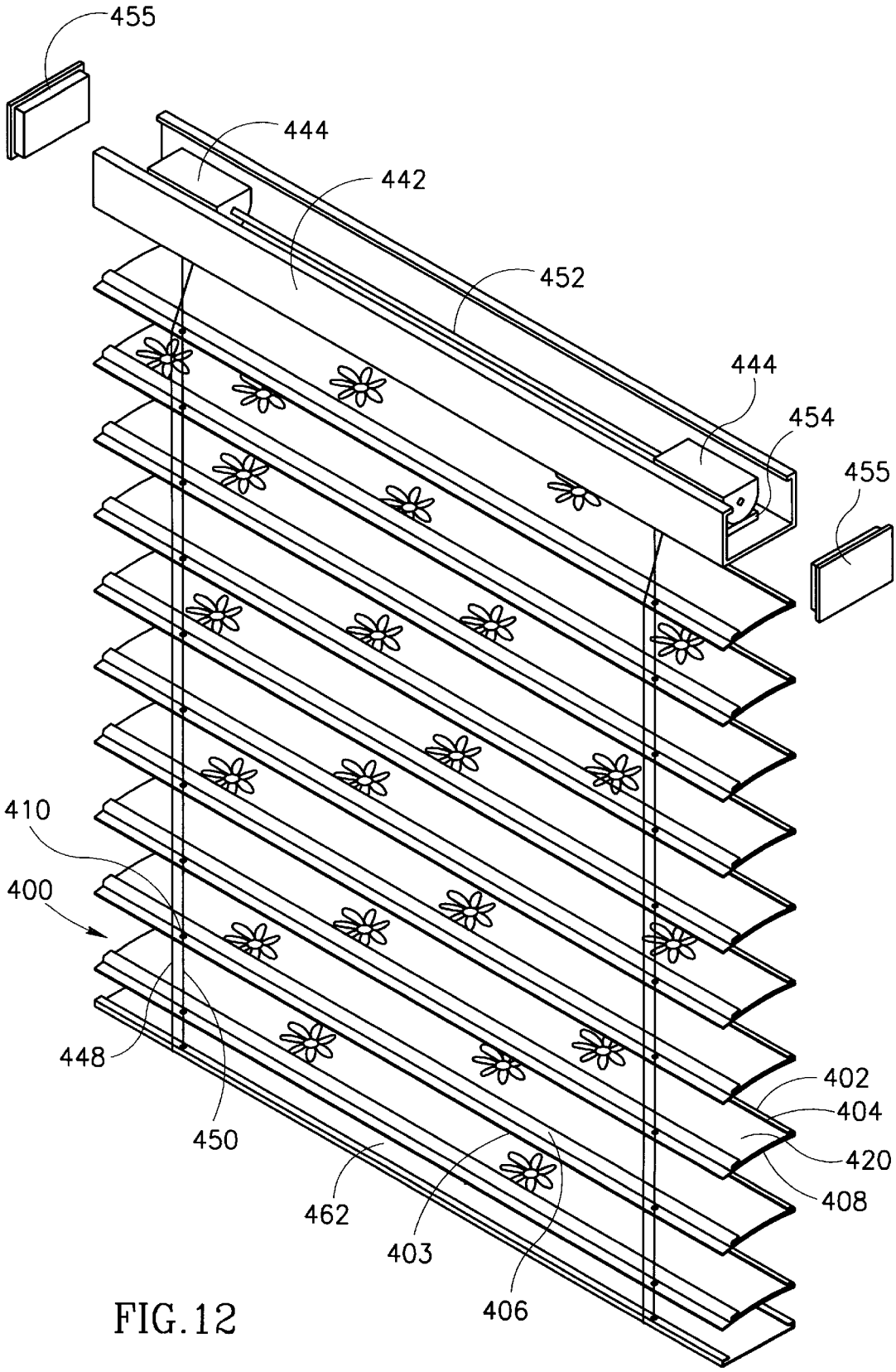
FIG. 12 is a rear view illustrating a venetian blind constructed in accordance with the present invention using the slat holder of FIG. 8.
Figure 13:
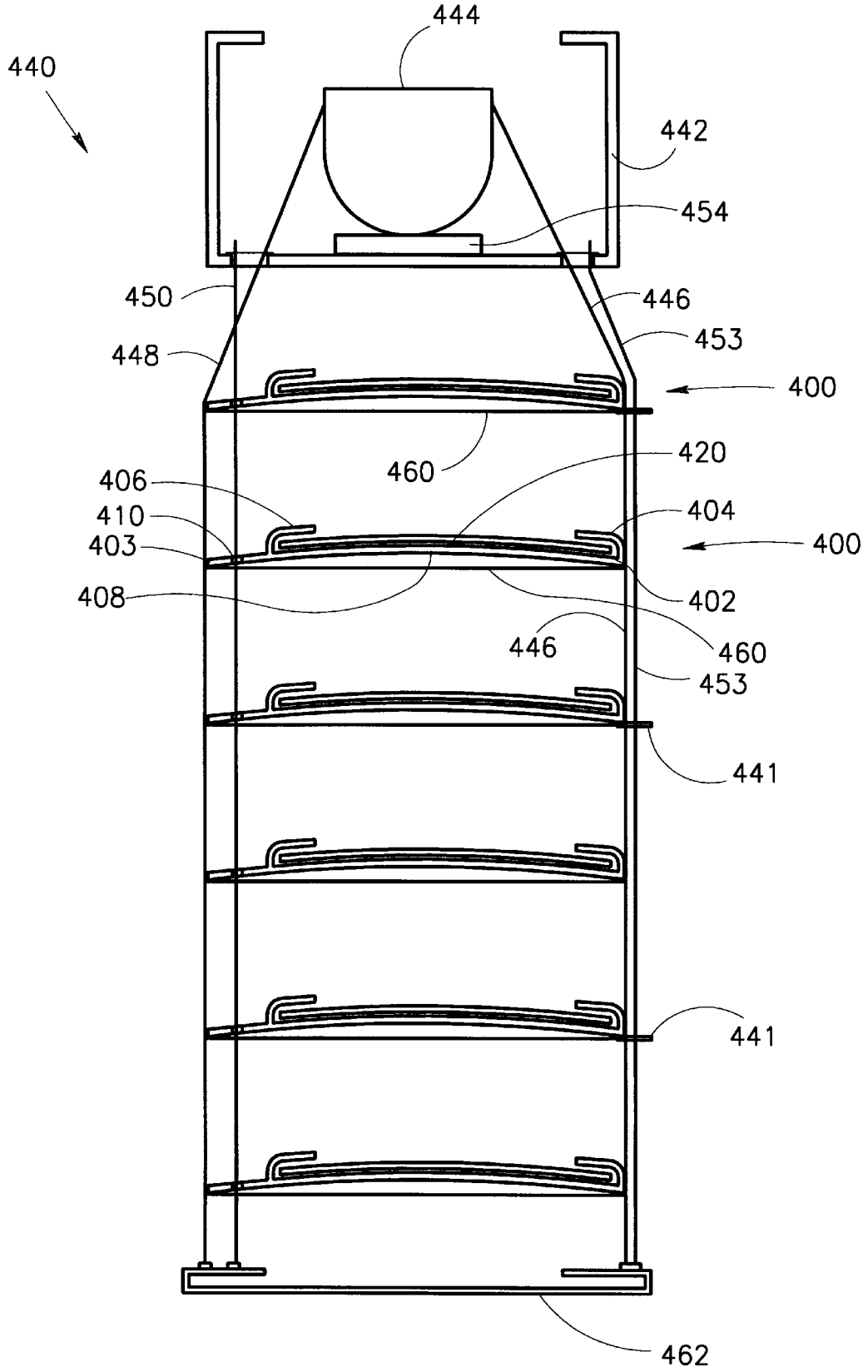
FIG. 13 is a side sectional view illustrating a venetian blind constructed in accordance with the present invention using the slat holder of FIG. 8.

A front view, rear view, side sectional view illustrating a venetian blind constructed in accordance with the present invention using the slat holder of FIG. 8 is shown in FIGS. 11, 12 and 13, respectively. The venetian blind 440 comprises a head rail 442, tilt drum or tilt rocker 444, tilt base 454 and a pinion gear 452. Attached to the tilt drums are front and rear tilt cords, 446, 448, respectively. Each slat holder 400 is supported by a slat rung or connecting cord 460 attached to the front and rear tilt cords. Each of the slat holders is shown with a slat insert 420 placed within the slat between the front and rear slat grips 404. 406, respectively.

Alternatively, the front and rear tilt cords can be attached to the front and rear edges of the slat holder, thus eliminating the need for rungs. The front and rear tilt cords are also fastened to the bottom rail 462.

The front lift cord 453 passes through the rings 441 attached to the slat holders. The rear lift cord 450 passes through holes 410 in each of the slat holders and is fastened to a bottom rail 462. The four lift cords 450, 453 are threaded through the head rail 442 so as to emerge together on the right portion of the blind. The four lift cords are fastened to a pull knob 116 to facilitate lifting of the blind. Tilt control rod 124 controls the amount of tilt the slats are set to via the tilt drum 444 in the head rail.

End caps 455 are placed on both ends of the head rail to hide the internal tilt and lift mechanisms located therein. Tilt drums 444 are positioned in the head rail so as to rock on tilt base 454. The tilt drums are connected by pinion gear 452. In particular, FIG. 13 illustrates the front and rear tilt cords 446, 448, respectively, attached to the tilt drums 444. The front and rear lift cords 453, 450, respectively, pass through the head rail and are tied together at pull knob 116 on one end and are attached to the bottom rail 462 on the other end. The front tilt cord and the front lift cord are arranged to pass through cord guides 441 attached to the front of some of the slat holders 400. Alternatively, the rear tilt cord 448 can be channeled through additional holes made in each slat holder 400 in close proximity to the rear slat grip 406.

Figure 14:
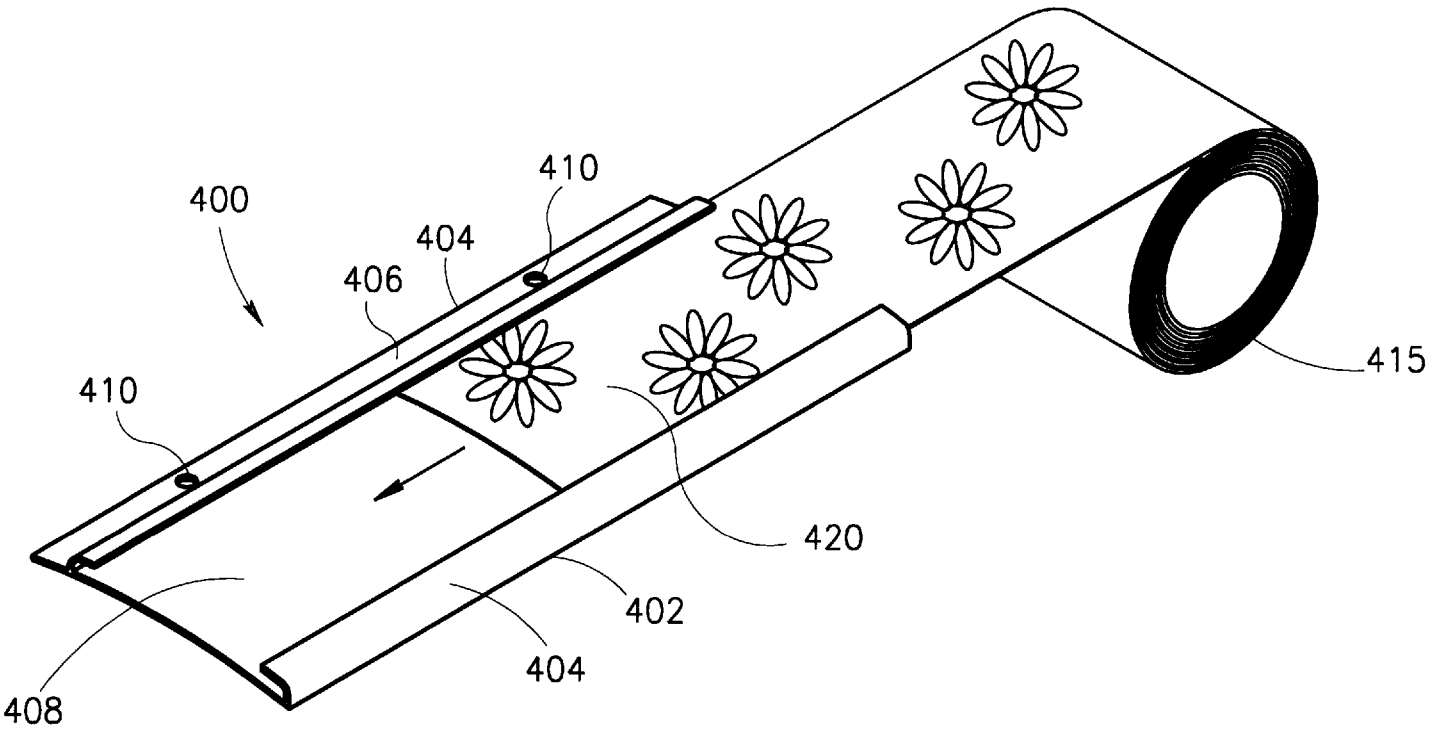
FIG. 14 illustrates the insertion of a fabric slat insert into the slat holder during construction of a custom made venetian blind.

An illustration of a fabric insert being inserted into the slat holder during manufacture of a custom width slat is shown in FIG. 14. The fabric insert is fed into the slat holder 400 from the roll of fabric 415. The fabric insert 420 is fed between the front and rear slat grips, 404, 406, respectively. The fabric insert 420 is cut so it fits the entire length of the slat holder.

It is important to note the distinction between a venetian blind constructed using the slat holder of either the first or second embodiment with two or more slat extensions and a venetian blind constructed using either the slat holder of the first or second embodiment with a single slat insert. The venetian blinds of the latter must, for the most part, be custom made except for the slat inserts placed within the slat holders. Thus, the length of the slat holders must be measured and cut for installation in a particular window frame. For use in custom installations, it is preferable that the slat holder be constructed from a clear plastic in order to allow light to pass through. This permits a user to choose to place a slat insert, e.g., plastic or fabric, into the slat holder that permits the desired amount of light to pass through the blind when in the closed position. Slat inserts can be chosen that are more translucent or more opaque in accordance with the needs of the individual user. In addition, an advantage of constructing the slat inserts from fabric is that they can be easily inserted and cut to any desired length. In addition they are easily removable for cleaning, changing colors, changing logos, etc.

While the invention has been described with respect to a limited number of embodiments, it will be appreciated that many variations, modifications and other applications of the invention may be made.

What is claimed is:

1. A venetian blind, comprising:

a head rail having a lift cord drive assembly and a tilt cord drive assembly;

a plurality of lift cord assemblies attached to said lift cord drive assembly in said head rail, each lift cord assembly comprising:

a front lift cord;

a rear lift cord; and a plurality of tilt cord assemblies attached to said tilt cord drive assembly in said head rail, each tilt cord assembly comprising:

a front tilt cord;

a rear tilt cord; and a plurality of cord rungs each connecting said front tilt cord and said rear tilt cord;

a plurality of elongate slats, at least one of which is an independently adjustable slat, each slat comprising:

an elongate slat holder having a front edge and a rear edge along opposing longitudinal edges of said slat holder, the slat holder further having a an elongate front grip substantially flush with said front edge and an elongate rear grip set back from said rear edge;

a plurality of elongate slat extensions, said plurality of slat extensions inserted in said slat holder one overlapping another and slideably held by said front and rear edge grips, each slat extension independently movable with respect to the other slat extensions such that the width of said slat can be varied independently of other slats in said venetian blind; and wherein said front tilt cords and said front lift cords extend outside of and adjacent to said front edge of said slat holder, said rear lift cords extend through a plurality of apertures in said slat holder functioning as cord guides and positioned between said rear grip and said rear edge; and wherein each slat rests on at least a pair of cord rungs and neither said front tilt cords, said rear tilt cords, said front lift cords nor said rear lift cords pass through any of said plurality of slat extensions.

2. The venetian blind according to claim 1, wherein at least one of said slat holders includes one of said apertures for said rear tilt cord and an aperture for said rear lift cord being offset from each other such that the operation of said rear tilt cord does not interfere with the operation of said rear lift cord.

3. The venetian blind according to claim 1, wherein said head rail further comprises:

a set of rear tilt cord apertures;

a set of rear lift cord apertures; and wherein said set of rear lift cord apertures is offset from said set of rear tilt cord apertures and substantially aligned with said apertures in said slat holder such that when said lift cord exits said head rail, it is in substantial alignment with said apertures.

4. The venetian blind according to claim 1, further comprising a width adjustable valance, said width adjustable valence having at least two adjustable valance segments capable of independent lateral extension and wherein the width of said valence can be varied independently of the width of said slats.

5. The venetian blind according to claim 1, further comprising a width adjustable bottom rail, said width adjustable bottom rail having at least two adjustable segments capable of independent lateral extensions and wherein the width of said bottom rail can be varied independently of the width of said slats.

6. The venetian blind according to claim 1, wherein said slat extensions are removable without requiring disassembly of said tilt cords or said lift cords.

7. A venetian blind, comprising:

a head rail having a lift cord drive assembly and a tilt cord drive assembly;

a plurality of lift cord assemblies attached to said lift cord drive assembly in said head rail, each lift cord assembly comprising:

a front lift cord;

a rear lift cord; and a plurality of tilt cord assemblies attached to said tilt cord drive assembly in said head rail, each tilt cord assembly comprising:

a front tilt cord; and a rear tilt cord;

a plurality of elongate slats, at least one of which is an independently adjustable slat, each slat comprising:

an elongate slat holder having a front edge and a rear edge along opposing longitudinal edges of said slat holder, the slat holder further having an elongate front grip substantially flush with said front edge and an elongate rear grip set back from said rear edge;

a plurality of elongate slat extensions, said plurality of slat extensions inserted in said slat holder one overlapping another and slideably held by said front and rear edge grips, each slat extension independently movable with respect to the other slat extensions such that the width of said slat can be varied independently of other slats in said venetian blind; and wherein said front tilt cords and said front lift cords extend outside of and adjacent to said front edge of said slat holder, said rear lift cords extend through a plurality of apertures in said slat holder functioning as cord guides and positioned between said rear grip and said rear edge; and wherein neither said front tilt cords, said rear tilt cords, said front lift cords nor said rear lift cords pass through any of said plurality of slat extensions.

8. The venetian blind according to claim 7, wherein at least one of said slat holders includes one of said apertures for said rear tilt cord and an aperture for said rear lift cord being offset from each other such that the operation of said rear tilt cord does not interfere with the operation of said rear lift cord.

9. The venetian blind according to claim 7, wherein said head rail further comprises:

a set of rear tilt cord apertures:

a set of rear lift cord apertures; and wherein said set of rear lift cord apertures is offset from said set of rear tilt cord apertures and substantially aligned with said apertures in said slat holder such that when said lift cord exits said head rail, it is in substantial alignment with said apertures.

10. The venetian blind according to claim 7, further comprising a width adjustable valance, said width adjustable valence having at least two adjustable valance segments capable of independent lateral extension and wherein the width of said valence can be varied independently of the width of said slats.

11. The venetian blind according to claim 7, further comprising a width adjustable bottom rail, said width adjustable bottom rail having at least two adjustable segments capable of independent lateral extensions and wherein the width of said bottom rail can be varied independently of the width of said slats.

12. The venetian blind according to claim 7, wherein said slat extensions are removable without requiring disassembly of said tilt cords or said lift cords.

13. A venetian blind, comprising:

a head rail having a lift cord drive assembly and a tilt cord drive assembly;

a plurality of lift cord assemblies attached to said lift cord drive assembly in said head rail, each lift cord assembly comprising:
a front lift cord;
a rear lift cord; and a plurality of tilt cord assemblies attached to said tilt cord drive assembly in said head rail, each tilt cord assembly comprising:
a front tilt cord: and
a rear tilt cord;

a plurality of elongate slats, each slat comprising:
an elongate slat holder having a front edge and a rear edge along opposing longitudinal edges of said slat holder, the slat holder further having an elongate front grip substantially flush with said front edge and an elongate rear grip set back from said rear edge;
an elongate slat insert inserted in said slat holder and slideably held by said front and rear edge grips each slat insert movable with respect to said slat holder; and wherein said front tilt cords and said front lift cords extend outside of and adjacent to said front edge of said slat holder, said rear lift cords extend through a plurality of apertures in said slat holder functioning as cord guides and positioned between said rear grip and said rear edge; and wherein neither said front tilt cords, said rear tilt cords, said front lift cords nor said rear lift cords pass through any of said slat inserts.

14.The venetian blind according to claim 13, wherein at least one of said slat holders includes one of said apertures for said rear tilt cord and an aperture for said rear lift cord being offset from each other such that the operation of said rear tilt cord does not interfere with the operation of said rear lift cord.

15. The venetian blind according to claim 13, wherein said head rail further comprises:

a set of rear tilt cord apertures;

a set of rear lift cord apertures; and wherein said set of rear lift cord apertures is offset from said set of rear tilt cord apertures and substantially aligned with said apertures in said slat holder such that when said lift cord exits said head rail, it is in substantial alignment with said apertures.

16. The venetian blind according to claim 13, further comprising a valance.

17. The venetian blind according to claim 13, further comprising a bottom rail, said tilt cords and said lift cords fastened to said bottom rail.

18. The venetian blind according to claim 13, wherein said slat inserts are removable without requiring disassembly of said tilt cords or said lift cords.

19. A venetian blind, comprising;

a head rail having a lift cord drive assembly and a tilt cord drive assembly;

a plurality of lift cord assemblies attached to said lift cord drive assembly in said head rail, each lift cord assembly comprising:
a front lift cord;
a rear lift cord; and a plurality of tilt cord assemblies attached to said tilt cord drive assembly in said head rail, each tilt cord assembly comprising:
a front tilt cord; and
a rear tilt cord;

a plurality of elongate slats, each slat comprising an elongate slat holder having a front edge and a rear edge along opposing longitudinal edges of said slat holder, the slat holder further having an elongate front grip substantially flush with said front edge and an elongate rear grip set back from said rear edge;

wherein said front tilt cords and said front lift cords extend outside of and adjacent to said front edge of said slat holder, said rear lift cords extend through a plurality of apertures in said slat holder functioning as cord guides and positioned between said rear grip and said rear edge; and wherein neither said front tilt cords, said rear tilt cords, said front lift cords nor said rear lift cords pass through the area of said slat holder between said elongate front grip and said elongate rear grip.

20. The venetian blind according to claim 1, wherein said elongate slat holder is substantially clear such that said elongate slat extensions are visible therethrough.

21. The venetian blind according to claim 7, wherein said elongate slat holder is substantially clear such that said elongate slat extensions are visible therethrough.

22. The venetian blind according to claim 13, wherein said elongate slat holder is substantially clear such that said elongate slat insert is visible therethrough.

23. The venetian blind according to claim 19, wherein said elongate slat holder is substantially clear.

* * * * *